US009087478B2

(12) United States Patent
Jeong et al.

(10) Patent No.: US 9,087,478 B2
(45) Date of Patent: Jul. 21, 2015

(54) DISPLAY DEVICE AND DRIVING METHOD THEREOF

(71) Applicant: Samsung Display Co., Ltd., Yongin (KR)

(72) Inventors: Ji-Woong Jeong, Yongin-si (KR); Nam-Gon Choi, Asan-si (KR); Geun Jeong Park, Daegu (KR); Dong-Won Park, Hwaseong-si (KR); Yong Jun Jang, Yongin-si (KR); Cheol Woo Park, Suwon-si (KR); Jeong-Hun So, Hwaseong-si (KR); Hyun Dae Lee, Hwaseong-si (KR)

(73) Assignee: Samsung Display Co., Ltd., Yongin (KR)

( * ) Notice: Subject to any disclaimer, the term of this patent is extended or adjusted under 35 U.S.C. 154(b) by 135 days.

(21) Appl. No.: 14/016,947

(22) Filed: Sep. 3, 2013

(65) Prior Publication Data

US 2014/0184670 A1 Jul. 3, 2014

(30) Foreign Application Priority Data

Dec. 31, 2012 (KR) ..... 10-2012-0158263

(51) Int. Cl.
*G09G 3/36* (2006.01)
*G09G 3/20* (2006.01)
(Continued)

(52) U.S. Cl.
CPC ..... *G09G 3/2003* (2013.01); *G09G 3/3225* (2013.01); *G09G 3/3666* (2013.01); *G09G 5/37* (2013.01); *G09G 2310/0221* (2013.01); *G09G 2310/0232* (2013.01); *G09G 2320/029* (2013.01); *G09G 2320/0233* (2013.01);
(Continued)

(58) Field of Classification Search
CPC ..... G09G 2320/0276; G09G 2320/0626; G09G 3/3648; G09G 2360/16
See application file for complete search history.

(56) References Cited

U.S. PATENT DOCUMENTS 5,396,257 A 3/1995 Someya et al.
5,668,569 A 9/1997 Greene et al.
5,844,532 A * 12/1998 Silverbrook et al. ..... 345/89
(Continued)

FOREIGN PATENT DOCUMENTS

KR 10-1999-0074451 10/1999
KR 10-0318533 12/2001
(Continued)

OTHER PUBLICATIONS

Extended European Search Report issued in European Application No. 13184503.4, dated Feb. 7, 2014.

*Primary Examiner* — Kevin Nguyen
(74) *Attorney, Agent, or Firm* — H.C. Park & Associates, PLC

(57) ABSTRACT

A display device and a method of driving a display device including: storing information on a stitch pattern; setting a data processing region disposed in a vicinity of a horizontal center line of a display panel and including a plurality of pixels; and performing data processing of changing gray of data for a portion of the plurality of pixels of the data processing region according to the information on the stitch pattern. The display panel includes a plurality of pixels arranged in a form of a matrix, a plurality of first data lines disposed in a first display panel region on a first side of the horizontal center line, and a plurality of second data lines disposed in a second display panel region on a second side of the horizontal center line opposite the first side.

46 Claims, 13 Drawing Sheets

(51) Int. Cl.
*G09G 3/32* (2006.01)
*G09G 5/37* (2006.01)

(52) U.S. Cl.
CPC .... *G09G2320/0285* (2013.01); *G09G 2330/12* (2013.01); *G09G 2360/128* (2013.01)

(56) References Cited

U.S. PATENT DOCUMENTS

| | | | | |
|---|---|---|---|---|
| 6,292,157 | B1 | 9/2001 | Greene et al. | |
| 6,377,713 | B1 | 4/2002 | Vuong | |
| 6,397,313 | B1 | 5/2002 | Kasa et al. | |
| 7,116,299 | B2 | 10/2006 | Nah et al. | |
| 7,564,443 | B2 | 7/2009 | Takatori et al. | |
| 8,022,922 | B2 | 9/2011 | Kang | |
| 2004/0001429 | A1 | 1/2004 | Ma et al. | |
| 2006/0055645 | A1 | 3/2006 | Kim | |
| 2006/0187234 | A1 | 8/2006 | Deng et al. | |
| 2007/0002005 | A1 | 1/2007 | Kim et al. | |
| 2009/0163178 | A1 | 6/2009 | Kim | |
| 2011/0187763 | A1* | 8/2011 | Nose et al. | 345/690 |
| 2012/0044275 | A1 | 2/2012 | Kobayashi | |
| 2012/0200558 | A1 | 8/2012 | Okumura | |
| 2012/0223958 | A1* | 9/2012 | Irie et al. | 345/589 |

FOREIGN PATENT DOCUMENTS

| | | |
|---|---|---|
| KR | 10-0448937 | 9/2004 |
| KR | 10-2007-0071982 | 7/2007 |
| KR | 10-2010-0130086 | 12/2010 |
| KR | 10-2011-0002105 | 1/2011 |
| WO | 2012/157651 | 11/2012 |

* cited by examiner

DISPLAY DEVICE AND DRIVING METHOD THEREOF

CROSS-REFERENCE TO RELATED APPLICATION

This application claims priority from and the benefit of Korean Patent Application No. 10-2012-0158263, filed on Dec. 31, 2012, which is hereby incorporated by reference for all purposes as if fully set forth herein.

BACKGROUND

1. Field

Exemplary embodiments of the present invention relate to a display device and a driving method thereof, and more particularly, to a display device capable of improving a display characteristic of the display device including a plurality of data drivers, and a driving method thereof.

2. Discussion of the Background

A display device, such as a liquid crystal display (LCD) and an organic light emitting diode (OLED) display, generally includes a display panel including a plurality of pixels and a plurality of signal lines, a gray voltage generator for generating a gray reference voltage, a data driver for generating a plurality of gray voltages by using the gray reference voltage, and applying a gray voltage corresponding to an input image signal among the generated gray voltages to a data line as a data signal, and the like. Each pixel may include a switching element, such as a thin film transistor, connected to a gate line and a data line, a pixel electrode connected with the switching element, and an opposed electrode facing opposite the pixel electrode and receiving a common voltage.

The driver may be directly mounted on the display panel in the form of at least one integrated circuit chip; may be mounted on a film, such as a flexible printed circuit film, and the like; may be attached to the display panel in a form of a tape carrier package (TCP), may be mounted on a separate printed circuit board, or may be integrated in the display panel, together with the signal line and the thin film transistor.

Recently, as display devices become larger and resolution increases, the amount of data required to be transmitted for a time is increased, and high-rate driving is needed in order to apply data of an image of one frame to the display panel. Further, a signal delay (RC delay) of the gate line and the data line is increased as the display panel becomes large. Accordingly, in a case of a method of applying a data voltage from one side of the display panel, it is difficult to sufficiently secure a charging time of the pixel, and an amount of data to be processed by one data driving circuit may be increased. As a result, a method of forming the data drivers at opposing sides of the display panel and simultaneously transmitting the data voltage to the pixel from both sides of the display panel (referred to as a "dual bank method") has been suggested. In the dual bank method, the display panel is divided into two regions based on a center line, and the data drivers are connected to the data lines of the regions, respectively, to apply the data voltage.

However, according to the dual bank method, a difference may be generated in driving voltages of the different data drivers, and a difference may be generated in a signal delay in an upper display panel region and a lower display panel region. Accordingly, even though the same gray level is displayed, a luminance difference may be generated in the two regions of the display panel, and especially, a horizontal line separating the luminance difference may be viewed around the center line that is a boundary of the upper display panel region and the lower display panel region.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide an improvement in display quality such that a horizontal line resulting from a luminous difference is not viewed in a display device by a dual bank method.

Additional features of the invention will be set forth in the description which follows, and in part will be apparent from the description, or may be learned by practice of the invention.

An exemplary embodiment of the present invention discloses a method of driving is a display device, the method including: storing information on a stitch pattern; setting a data processing region positioned in a vicinity of a horizontal center line of a display panel and including a plurality of pixels; and performing data processing of changing gray level of data for a portion of the plurality of pixels of the data processing region according to the information on the stitch pattern. The display device includes: the display panel including a plurality of pixels arranged in a form of a matrix, a plurality of first data lines positioned in a first display panel region at a first side based on the horizontal center line, and a plurality of second data lines positioned in a second display panel region at a second side opposite to the first side based on the horizontal center line; a first data driver configured to apply a data voltage to the plurality of first data lines; and a second data driver configured to apply a data voltage to the plurality of second data lines.

Another exemplary embodiment of the present invention also discloses a display device, including: a display panel including a plurality of pixels arranged in a form of a matrix, a plurality of first data lines positioned in a first display panel region at a first side based on a horizontal center line, and a plurality of second data lines positioned in a second display panel region at a second side opposite the first side based on the horizontal center line; a first data driver configured to apply data voltages to the plurality of first data lines; a second data driver configured to apply data voltages to the plurality of second data lines; and a signal controller configured to control the first and second data drivers and including a data processor. The data processor generates image data by performing data processing of changing gray level of data for a portion among the plurality of pixels in a data processing region positioned in a vicinity of the horizontal center line of the display panel according to information on a stitch pattern.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
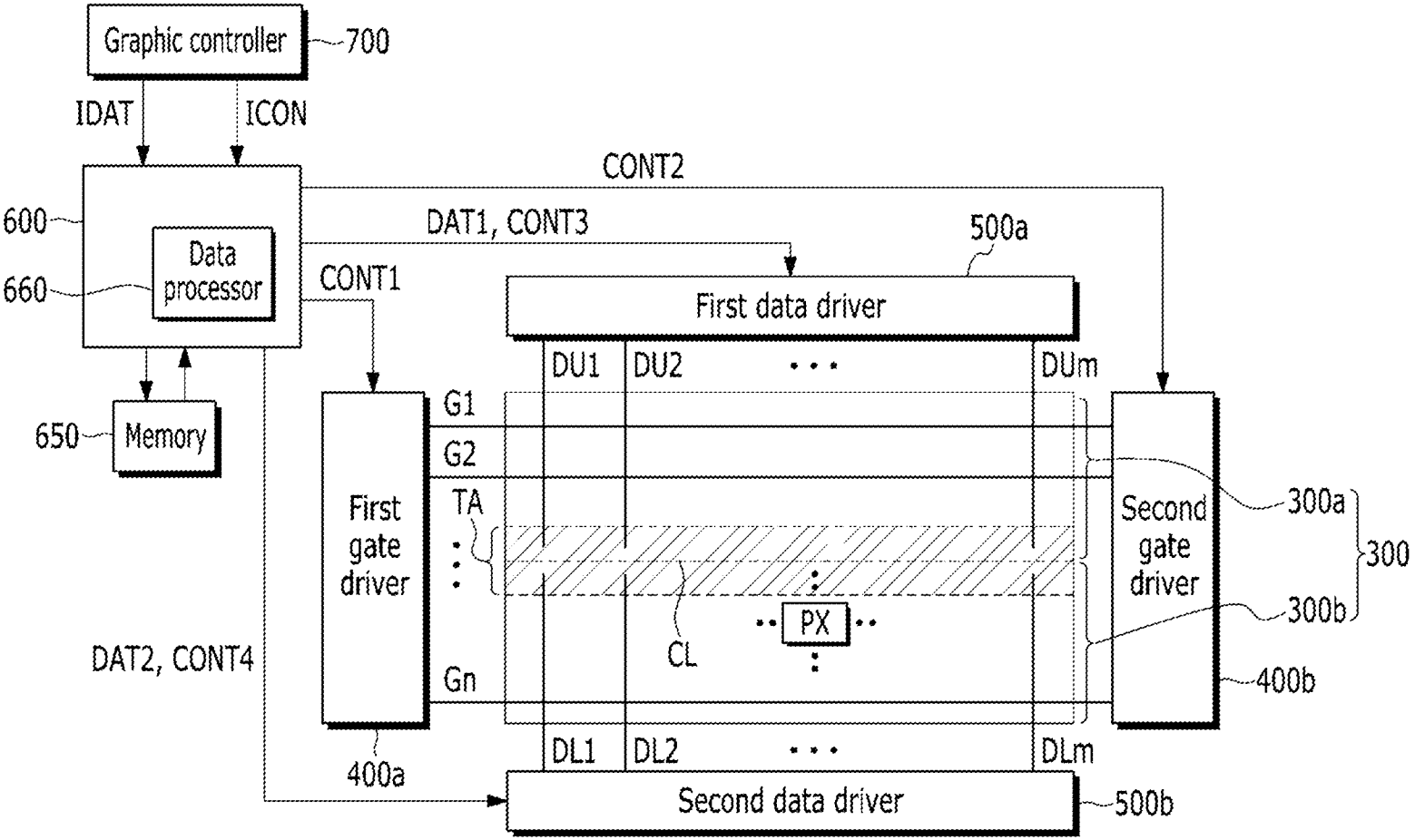
FIG. 1 is a block diagram of a display device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity Like reference numerals in the drawings denote like elements.

It will be understood that when an element or layer is referred to as being "on," "connected to," or "coupled to" another element or layer, it can be directly on, directly connected to, or directly coupled to the other element or layer, or intervening elements or layers may be present. In contrast, when an element or layer is referred to as being "directly on," "directly connected to," or "directly coupled to" another element or layer, there are no intervening elements or layers present. It will be understood that for the purposes of this disclosure, "at least is one of X, Y, and Z" can be construed as X only, Y only, Z only, or any combination of two or more items X, Y, and Z (e.g., XYZ, XYY, YZ, ZZ).

A display device according to an exemplary embodiment of the present invention, and a driving method thereof will be described in detail with reference to the drawings.

First, the display device according to an exemplary embodiment of the present invention will be described with reference to FIGS. 1 to 4.

Figure 2:
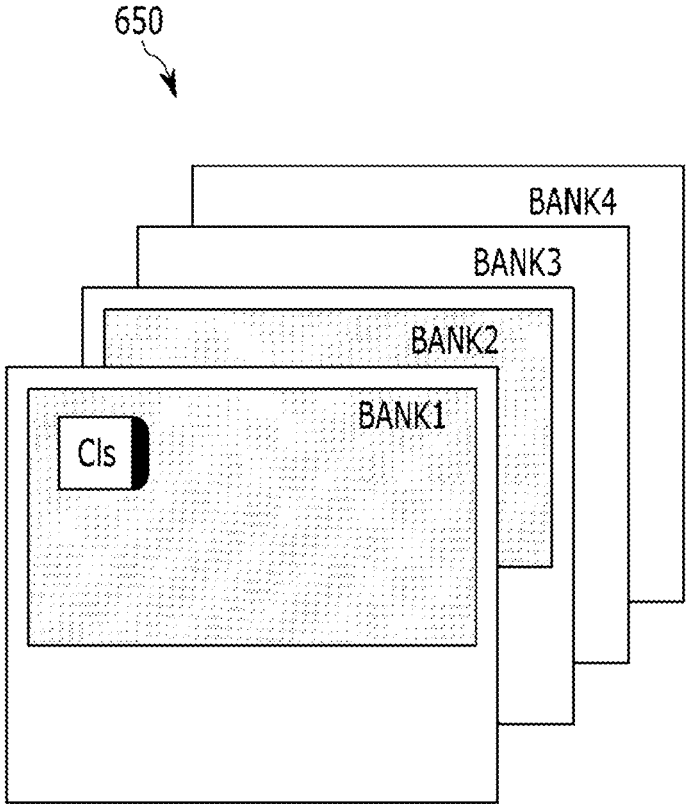
FIG. 2 is a view illustrating a structure of a memory of the display device illustrated in FIG. 1.
Figure 3:
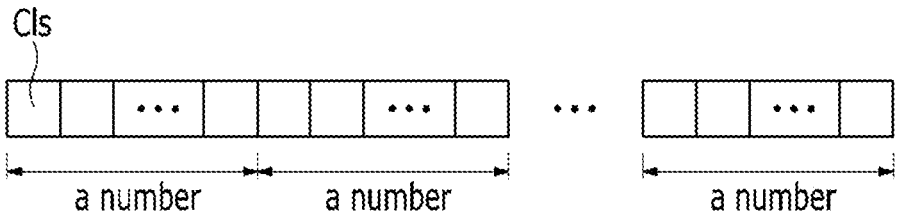
FIG. 3 is a conceptual diagram illustrating a method of reading or storing data from the memory of the display device according to an exemplary embodiment of the present invention.
Figure 4:
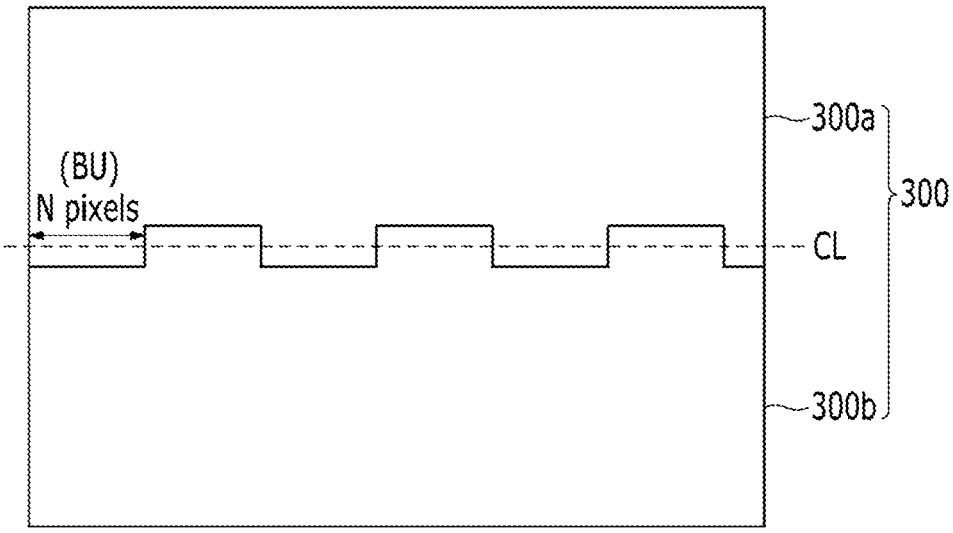
FIG. 4 is a view illustrating a unit block serving as a unit for data processing among pixels of one row of a display panel of the display device according to an input/output method of data illustrated in FIG. 3.

FIG. 1 is a block diagram of a display device according to an exemplary embodiment of the present invention, FIG. 2 is a view illustrating a structure of a memory of the display device illustrated in FIG. 1, FIG. 3 is a conceptual diagram illustrating a method of reading or storing data from the memory of the display device according to the exemplary embodiment of the present invention, and FIG. 4 is a view illustrating a unit block serving as a unit for data processing among pixels of one row of a display panel of the display device according to the input/output method of data illustrated in FIG. 3.

Referring to FIG. 1, the display device includes a display panel 300, first and second gate drivers 400*a* and 400*b*, first and second data drivers 500*a* and 500*b*, a signal controller 600, a memory 650, and a graphic controller 700.

The display panel 300 may be a display panel included in various flat panel displays (FPDs), such as a liquid crystal display (LCD), an organic light emitting display (OLED), and an electrowetting display (EWD).

The display panel 300 includes a plurality of signal lines, and a plurality of pixels PX connected to the plurality of signal lines and arranged in a form of an approximate matrix as an equivalent circuit. Hereinafter, a row direction is referred to as a horizontal direction, and a column direction is referred to as a vertical direction.

The display panel 300 is divided into an upper display panel region 300*a* and a lower display panel region 300*b* based on a horizontal center line CL. The number of pixels PX positioned in the upper display panel region 300*a* based on the horizontal center line CL may be the same as the number of the pixels PX positioned in the lower display panel region 300*b*, but is not limited thereto. The horizontal center line CL may substantially be a straight line.

The display panel 300 includes a data processing region TA having an area based on the horizontal center line CL. The data processing region TA may be vertically symmetric based on the horizontal center line CL, but is not limited thereto. For example, the data processing region TA may include only an upper region of the horizontal center line CL, only a lower region of the horizontal center line CL, or a lower region and an upper region having different areas based on the horizontal center line CL. The area of the data processing region TA does not exceed a half of the display region of the entire display panel 300. A method of processing data in the data processing region TA will be described in detail below.

The signal lines include a plurality of gate lines G1 to Gn transmitting gate signals (also referred to as "scanning signals"), and a plurality of upper data lines DU1 to DUm and a plurality of lower data lines DL1 and DLm transmitting data voltages.

The gate lines G1 to Gn may extend in a row direction, and be substantially parallel to each other. The number of gate lines G1 to Gn may be an even number, and an upper half of the entire gate lines G1 to Gn may be positioned in the upper display panel region 300*a*, and the remaining lower half may be positioned in the lower display panel region 300*b*, but the gate lines G1 to Gn are not limited thereto, and the number of gate lines G1 to Gn of the upper display panel region 300*a* and the number of gate lines G1 to Gn of the lower display panel region 300*b* may be different from each other.

The upper data lines DU1 to DUm are positioned on the upper display panel region 300*a* and transmit data voltages for the upper side to be applied to the pixels PX of the upper display panel region 300*a*. The lower data lines DL1 to DLm are positioned on the lower display panel region 300*b* and transmit data voltages for the lower side to be applied to the pixels PX of the lower display panel region 300*b*. The number of upper data lines DU1 to DUm and the number of lower data lines DL1 to DLm may be the same, and the upper data lines DU1 to DUm and the lower data lines DL1 to DLm may form pairs to be arranged in an approximate column direction.

One pixel may include at least one switching element connected to at least one data line and at least one gate line, and at least one pixel electrode connected to the switching element. The switching element may include at least one thin film transistor, and may be controlled according to a gate signal transmitted by the gate line to transmit a data voltage transmitted by the data line to the pixel electrode.

Each pixel PX displays one of the primary colors (spatial division) or alternately displays the primary colors according to a time (temporal division) in order to implement color display, so that a desired color may be recognized with a spatial or temporal sum of the primary colors. The plurality of adjacent pixels PX displaying the different primary colors may together configure one set (referred to as a dot).

The first and the second gate drivers 400*a* and 400*b* receive gate control signals CONT1 and CONT2 from the signal controller 600, respectively, to generate gate signals including a combination of a gate-on voltage Von capable of turning on the switching element of the pixel PX and a gate-off voltage Voff capable of turning off the switching element of the pixel PX based on the received gate control signals CONT1 and CONT2. The gate control signal CONT1 may include a scanning start signal for directing a scanning start, a gate clock signal for controlling an output time of the gate-on voltage Von, and the like. The first and the second gate drivers 400*a* and 400*b* are connected to the gate lines G1 to Gn of the display panel 300 to apply the gate signals to the gate lines G1 to Gn.

According to another exemplary embodiment of the present invention, one of the first and second gate drivers 400*a* and 400*b* may be omitted.

The first and second data drivers 500*a* and 500*b* generate image data DAT1 and DAT2 as data voltages which are analog data signals by receiving data control signals CONT3 and CONT4 and image data DAT1 and DAT2 from the signal controller 600 and selecting gray voltages corresponding the image data DAT1 and DAT2, respectively. The data drivers 500*a* and 500*b* may also receive the gray voltages from a separate gray voltage generator (not illustrated), and may generate the gray voltages for an entire gray scale by receiving only a limited number of reference gray voltages and dividing the received reference gray voltages. The gray voltage or the reference gray voltage may be generated based on pre-stored gamma data. The gamma data may contain information for two or more different gamma curves.

The first data driver 500*a* is connected to the upper data line DU1 to DUm of the display panel 300 to apply the data voltage for the upper side to the corresponding upper data line DU1 or DUm. The second data driver 500*b* is connected to the lower data line DL1 to DLm of the display panel 300 to apply the data voltage for the lower side to the corresponding upper data line DL1 or DLm.

The signal controller 600 receives an input image signal IDAT and an input control signal ICON for controlling display of the input image signal IDAT from the graphic controller 700. The input image signal IDAT contains luminance information of each pixel PX, and the luminance information includes a number of gray levels, for example, $1024=2^{10}$, $256=2^{8}$, or $64=2^{6}$. An example of the input control signal ICON includes a vertical synchronization signal VSync, a horizontal synchronization signal HSync, a main clock signal, a data enable signal, and the like. The signal controller 600 may generate the gate control signals CONT1 and CONT2 and the data control signals CONT3 and CONT4, and generate preliminary image data by appropriately and preliminarily processing the input image signal IDAT in accordance with an operation condition of the display panel 300 based on the input image signal IDAT and the input control signal ICON. The preliminary processing of the data may include processing, such as DCC, of comparing the input image signal IDAT of an adjacent frame and appropriately correcting a gray level of the input image signal IDAT of a current frame.

Referring to FIG. 1, the signal controller 600 includes a data processor 660 for generating the image data DAT1 and DAT2 by processing the input image signal IDAT or the preliminary image data. In particular, the data processing unit 660 generates the image data DAT1 and DAT2 by processing the data for the aforementioned data processing region TA of the display panel 300. Here, the processing of the data may mean changing a gray level of the data. A detailed operation of the data processor 660 will be described in detail later.

The signal controller 600 sends the gate control signals CONT1 and CONT2 to the first and second gate drivers 400*a* and 400*b*, respectively, and sends the data control signals CONT3 and CONT4 and the image data DAT1 and DAT2 to the first and second data drivers 500*a* and 500*b*, respectively.

The signal controller 600 may further include a memory 650 for storing the input image signal IDAT or the preliminary image data (hereinafter, simply referred to as "data") of at least one frame. As illustrated in FIG. 1, the memory 650 may be separately provided from the signal controller 600 to be connected with the signal controller 600.

The memory 650, according to an exemplary embodiment of the present invention, may be a dual data rate (DDR) memory operated in a burst mode, and may be, for example, a DDR synchronous dynamic random access memory/synchronous graphic random access memory (DDR SDRAM/SGRAM).

Referring to FIG. 2, the memory 650 may include at least one bank for providing a simultaneous operation, and each bank may include a plurality of clusters Cls arranged in a form of a matrix. Each bank may include, for example, 4,096 rows and 256 columns. Further, the cluster Cls may be configured to have a plurality of bits, and for example, 32 bits. For example, in a case where an input image signal IDAT for one pixel PX is configured to have 10 bits and one cluster Cls is configured to have 32 bits, one cluster Cls may store the input image signals IDAT for approximately three pixels PX configuring one dot.

Referring to FIG. 3, the memory 650 may be operated in the burst mode. The burst mode is a mode for sequentially reading or writing the number of data stored in addresses continued from a first address in the memory 650, that is, a cluster, with one command. When the burst mode is used, it is possible to prevent excessive time consumption for setting an address after receipt of the initial command, thereby reading or writing data at a high rate.

A length of data continuously read or recorded from a first designated address with one command in the burst mode is referred to as a burst length. For example, when the burst length is 8, the clusters Cls within the memory 650 may be controlled in a unit of 8 clusters. The burst length may be equal to or greater than 1. FIG. 3 illustrates a case in which the burst length is a number of clusters ("a" is a natural number equal to or greater than 1), and data may be continuously read or recorded in the unit of clusters.

When the data is stored and output by using the memory 650 operated in the burst mode as described above, the signal controller 600 may process the data in the unit of the burst length of the memory 650.

Referring to FIG. 4, when the data processed in the unit of the burst length is output in the display panel 300, the data may be processed in the unit of a unit block BU including N pixels PX (N is a natural number equal to or larger than 2) corresponding to an integer multiple of the burst length even within one pixel row. In FIG. 4, regions divided in a zigzag form among the regions adjacent to the horizontal center line CL of the display panel 300 are the unit blocks BU, and may correspond to a data processing unit in the data processor 660 of the signal controller 600, that is, an integer multiple of the burst length. The unit block BU may include two or more continuous pixels PX within one pixel row.

The unit block BU may be changed according to the bit configuration of the memory 650 and the input image signal IDAT, and the burst length. For example, in a case where one cluster Cls stores data of one dot and the burst length is 8, the unit block BU may include a number of dots corresponding to an integer multiple of 8.

In a case of a display device with high resolution and a large area contrary to the display device illustrated in FIG. 1, each of the first data driver 500*a* and the second data driver 500*b* may be connected to at least one signal controller. In this case, the graphic controller 700 controls a plurality of signal controllers. Further, each signal controller may include each memory operated in the burst mode or may be connected to the memory.

The display device and the driving method, more particularly, a method of processing data of the signal controller 600 according to the exemplary embodiment of the present invention, will be described with reference to FIGS. 5 to 8 together with the aforementioned drawings.

FIGS. 5, 6, 7, and 8 are views illustrating one example of a stitch pattern for processing data in the display device according to the exemplary embodiment of the present invention.

Figure 5:
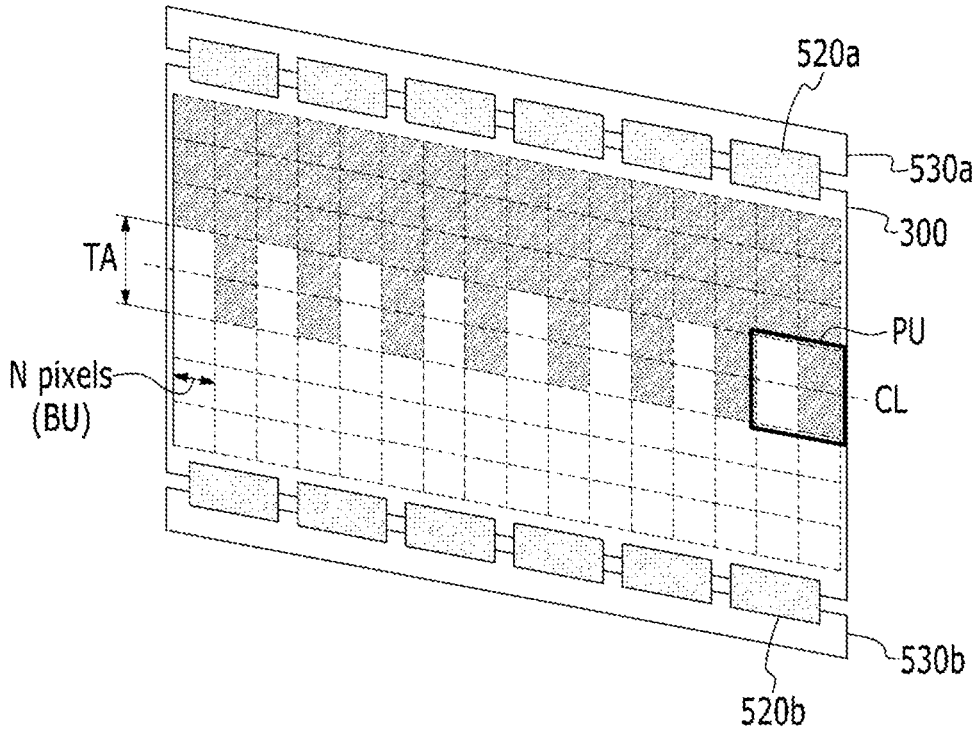
FIG. 5, FIG. 6, FIG. 7, and FIG. 8 are perspective views respectively illustrating one example of a stitch pattern for data processing in the display device according to an exemplary embodiment of the present invention.

Referring to FIG. 5, the first and second data drivers 500*a* and 500*b* may include a plurality of data driving chips (not illustrated), and the data driving chips may be positioned on first and second flexible printed circuit films (FPC film) 520*a* and 520*b* attached to an upper side and a lower side of the display panel 300, respectively. Every pair of data driving chips of the first and the second data drivers 500*a* and 500*b* may face each other.

The first and the second flexible printed circuit films 520*a* and 520*b* electrically connect the display panel 300 to the first and second printed circuit boards 530*a* and 530*b*. The signal controller 600, the memory 650, and the like may be mounted on the first and the second printed circuit boards 530*a* and 530*b*. In contrast to the illustration in FIG. 5, the first and second data drivers 500*a* and 500*b* may be directly mounted in a peripheral region of the display panel 300.

Referring to FIG. 5 together with the aforementioned drawings, the signal controller 600 receives the input image signal IDAT and the input control signal ICON from the graphic controller 700, and generates the gate control signals CONT1 and CONT2 and the data control signals CONT3 and CONT4 based on the input image signal IDAT and the input control signal ICON. The signal controller 600 may also generate preliminary image data by storing the input image signal IDAT in the memory 650, fetching the data in the aforementioned burst mode, appropriately and preliminarily processing the input image signal IDAT in accordance with the operation condition of the display panel 300. The preliminary processing of the data may be omitted.

The data processor 660 of the signal controller 600 processes the data corresponding to a region of the data processing region TA adjacent to the horizontal center line CL of the display panel 300 among the input image signal IDAT and the preliminary image data fetched from the memory 650. The data of the data processing region TA is processed in accordance with information on a stitch pattern.

The stitch pattern represents a pattern for converting a gray level of the data of the input image signal IDAT or the preliminary image data among the pixels PX of the data processing region TA, and may have at least one unit pattern PU. For example, the stitch pattern may include a plurality of unit patterns PU repeated along the horizontal center line CL as illustrated in FIG. 5. In addition, the stitch pattern may be variously set, and the information on the stitch pattern may be stored in a separate memory within the signal controller 600. The number of unit blocks BU included in the unit pattern PU or a shape of the unit pattern PU may be appropriately set according to the purpose of the present invention.

The unit pattern PU may include the unit block BU of which the data is processed, and the unit block BU of which the data is not processed. For example, the unit block displayed differently from the unit block BU other than the data processing region TA among the unit blocks BU positioned under the horizontal center line CL within the unit pattern PU is a portion of which data is processed, and the unit block BU identically displayed to the unit block BU other than the data processing region TA among the unit blocks BU positioned under the horizontal center line CL within the unit pattern PU is a portion of which the data is not processed.

One unit pattern PU illustrated in FIG. 5 will be described in more detail. The unit pattern PU may include the four unit blocks BU, and an entire shape of the unit pattern PU may be approximately square. According to the stitch pattern illustrated in FIG. 5, the data of a portion (right unit block) of the unit blocks BU of the unit pattern PU in the lower display panel region 300*b* based on the horizontal center line CL is processed by subtracting a gray level value from original data or adding the gray level value to the original data, and the data of a portion (left unit block) of the unit blocks BU of the unit pattern PU in the upper display panel region 300*a* is processed by adding the gray level value to the original data or subtracting the gray level value from the original data, in contrast to the lower display panel region 300*b*. In a case where the original data of the upper display panel region 300*a* is displayed with a gray color, and the original data of the lower display panel region 300*b* is displayed with a white color, a portion displayed with a white color among the unit blocks BU positioned at an upper side in the unit pattern PU and a portion displayed with a gray color among the unit blocks BU positioned at a lower side are the portions of which the data is processed.

For example, a case will be described in which luminance of the upper display panel region 300*a* is generally greater than that of the lower display panel region 300*b* for the input image signal IDAT of the same gray level because a driving voltage input in the first data driver 500*a* is greater than a driving voltage input in the second data driver 500*b*, or a signal delay of the lower display panel region 300*b* is greater than a signal delay of the upper display panel region 300*a*. In this case, the stitch pattern may be implemented by subtracting a gray level value from the original data for a portion of the unit blocks in the upper display panel region 300*a* in the data processing region TA and adding the gray level value for a portion of the unit blocks in the lower display panel region 300*b*. Here, the subtracted or added gray level value may be determined according to a luminance difference for the same gray level between the upper display panel region 300*a* and the lower display panel region 300*b*. A method of determining the gray level will be described later.

In contrast to this, the data processing may not be performed on the unit block BU positioned at one side based on the horizontal center line CL among the unit blocks BU of the unit pattern PU.

The data processed as described above are the image data DAT1 and DAT2 to be transmitted to the corresponding first and second data drivers 500*a* and 500*b*, respectively. The first and the second data drivers 500*a* and 500*b* convert the image data DAT1 and DAT2 to data voltages, and then apply the converted data voltages to the corresponding upper data lines DU1 to DUm and the lower data lines DL1 to DLm. The first and the second gate drivers 400*a* and 400*b* apply the gate-on voltage Von to the gate lines G1 to Gn according to the gate control signals CONT1 and CONT2 of the signal controller 600 to turn on the switching elements connected to the gate lines G1 to Gn. Then, the data voltages applied to the lower and upper data lines DL1 to DLm and DU1 to DUm are applied to the corresponding pixels PX through the turned-on switching elements. The pixel PX is charged with a difference between the applied data voltage and the common voltage to display luminance represented by the gray level of the input image signal IDAT.

As described above, according to an exemplary embodiment of the present invention, the display panel 300 is divided into the upper display panel region 300*a* and the lower display panel region 300*b*, and the data of the data processing region TA adjacent to the horizontal center line CL is processed according to the stitch pattern in the dual bank method driven by the first and second data drivers 500*a* and 500*b*, respectively. Then, in a case where a luminance difference is generated in the vicinity of the horizontal center line CL that is the boundary between the upper display panel region 300*a* and the lower display panel region 300*b* for the same gray level as a result of several factors, the luminance difference is vertically mixed based on the horizontal center line CL, so that it is possible to decrease the viewing of a horizontal line in the vicinity of the horizontal center line CL. Particularly, it is possible to make the unit block BU, that is, the data processing unit smaller as the burst length of the memory 650 is smaller, so that it is possible to configure the finer stitch pattern and more certainly decrease the viewing of the horizontal line.

Figure 6:
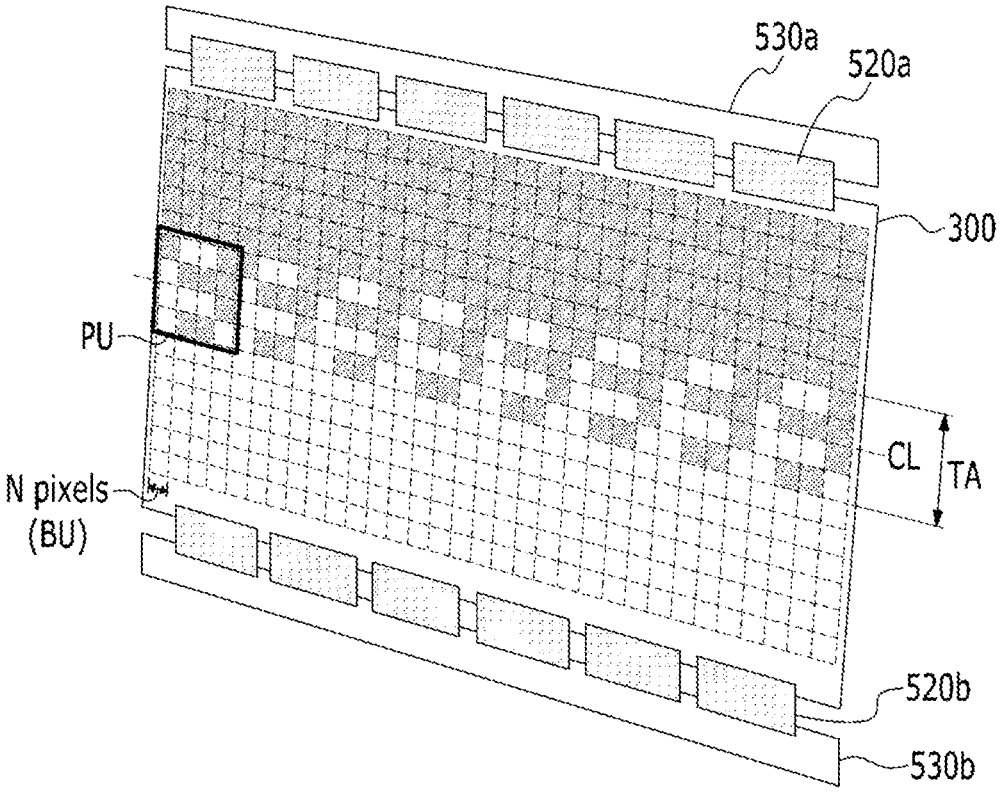

FIG. 6 illustrates another example of the stitch pattern based on which the data processor 660 processes the data. The unit pattern PU of the stitch pattern illustrated in FIG. 6 may include 16 unit blocks BU. In FIG. 6, in a case where the original data of the upper display panel region 300*a* is displayed with a gray color, and the original data of the lower display panel region 300*b* is displayed with a white color, a portion displayed with a white color among the unit blocks BU positioned at an upper side in the unit pattern PU and a portion displayed with a gray color among the unit blocks BU positioned at a lower side are the portions of which the data is processed. For example, three unit blocks BU, among the unit blocks BU positioned at the upper side based on the horizontal center line CL in the unit pattern PU, is data-processed, to be displayed as data having a larger or smaller gray level than that of the original data. In the meantime, for example, three unit blocks BU, among the unit blocks BU positioned at the lower side based on the horizontal center line CL, is data-processed in contrast to the unit block BU positioned at the upper side based on the horizontal center line CL, to be displayed as data having a larger or smaller gray level than that of the original data. The position of the data-processed portion in the unit pattern PU may be variously determined.

Figure 7:
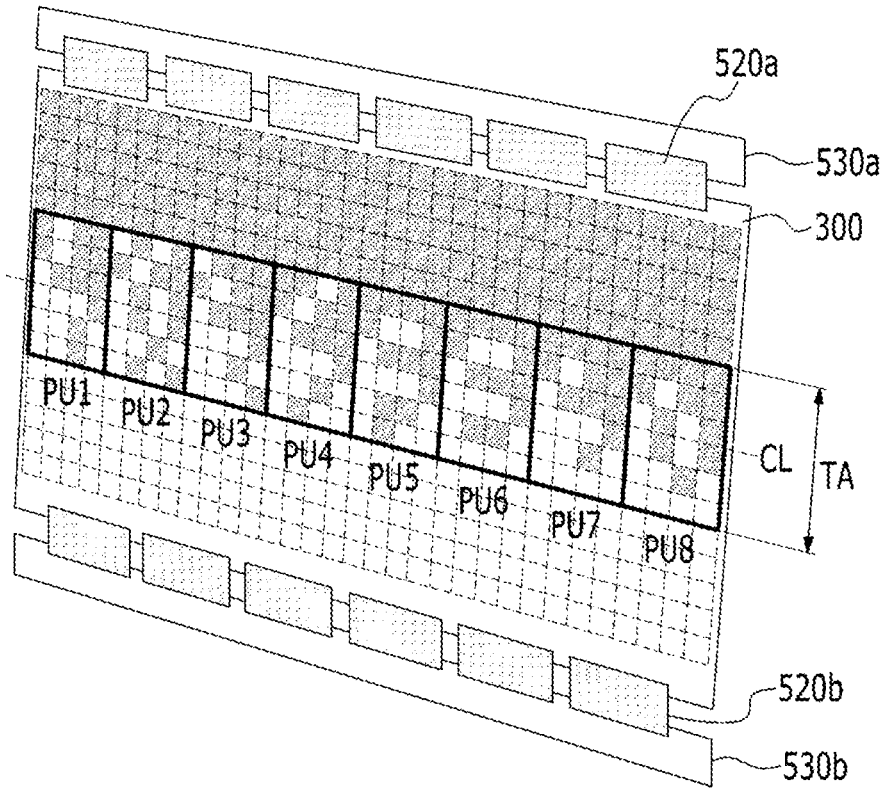
Figure 8:
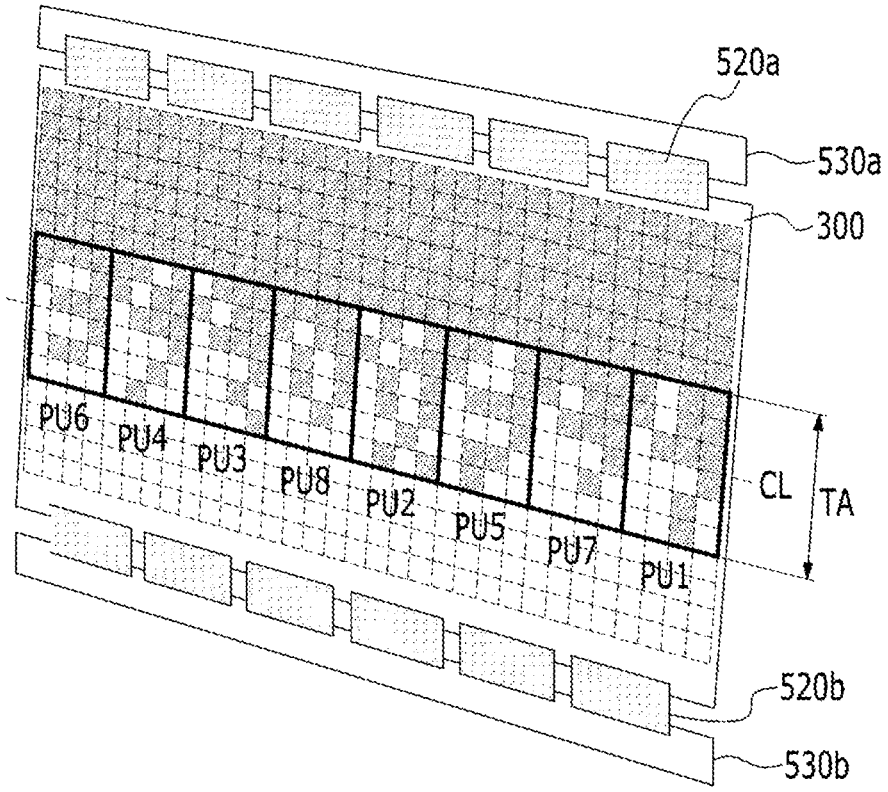

Referring to FIGS. 7 and 8, the stitch pattern that is the pattern based on which the data processor 660 according to the exemplary embodiment of the present invention processes the data may include a plurality of different unit patterns PU1 to PU8, which differs from the illustration of FIGS. 5 and 6. The plurality of unit patterns PU1 to PU8 may include the same number of unit blocks BU or the different number of unit blocks BU. FIG. 7 illustrates an example in which each of the unit patterns PU1 to PU8 includes 24 unit blocks BU, and an entire shape of each of the unit patterns PU1 to PU8 is an approximate rectangle.

FIG. 7 illustrates an example in which the stitch pattern includes every one of the plurality of different unit patterns PU1 to PU8, but in contrast to this, the different unit patterns PU1 to PU8 may be repeatedly disposed.

Referring to FIGS. 7 and 8, the stitch pattern is the pattern based on which the data processor 660 processes the data and may be different for each frame. For example, the stitch patterns illustrated in FIGS. 7 and 8 represent the stitch patterns in the continuous two frames. The stitch pattern in the continuous two frames may include the plurality of unit patterns PU1 to PU8 having the same form, and a disposition sequence of the unit patterns PU1 to PU8 in the continuous two frames may be changed. As described above, the stitch patterns having the different shapes may be alternately repeated for each of a number of frames. Accordingly, the stitch pattern in the vicinity of the horizontal center line CL may have a smoother boundary surface without a change in luminance for each frame.

Simultaneously, one pixel PX of the display device may display an image by receiving data voltages according to different gamma curves for one frame set including continuous two or more frames for one input image signal IDAT, which is referred to as time division driving. To this end, the signal controller 600 may perform doubling on one input image signal IDAT to a plurality of frames configuring one frame set. The gamma curve is a curve representing luminance or transmittance for the gray level of the input image signal IDAT, and the gray voltage or the reference gray voltage may be set based on the gamma curve.

The different gamma curves applied to the plurality of doubled frames may include first and second gamma curves for improving side visibility. Here, the luminance of the image according to the first gamma curve is defined to be greater than or equal to the luminance of the image according to the second gamma curve. The first and second gamma curves may be adjusted so that a combination gamma curve in a front side of the two gamma curves is matched to a front gamma curve (for example, a gamma curve having a gamma value of 2.2.) set to be most appropriate to the display device, and a combination gamma curve at a side is maximally close to the front gamma curve.

In a case where one frame set includes two frames, one input image signal is doubled for the two frames, and the different gamma curves are applied to the two frames, so that the generated data voltage may be input in the display panel 300. For example, one of the doubled two frames displays an image according to the first gamma curve (referred to as a first image), and the other frame may display an image according to the second gamma curve (referred to as a second image). As described above, according to the time division driving, the images according to the different gamma curves are displayed in the continuous frames, so that it is possible to improve side visibility.

A display device according to an exemplary embodiment of the present invention will be described with reference to FIGS. 9 to 11. The same elements as those of the aforementioned exemplary embodiment are denoted with the same reference numerals, and the same description will be omitted.

Figure 9:
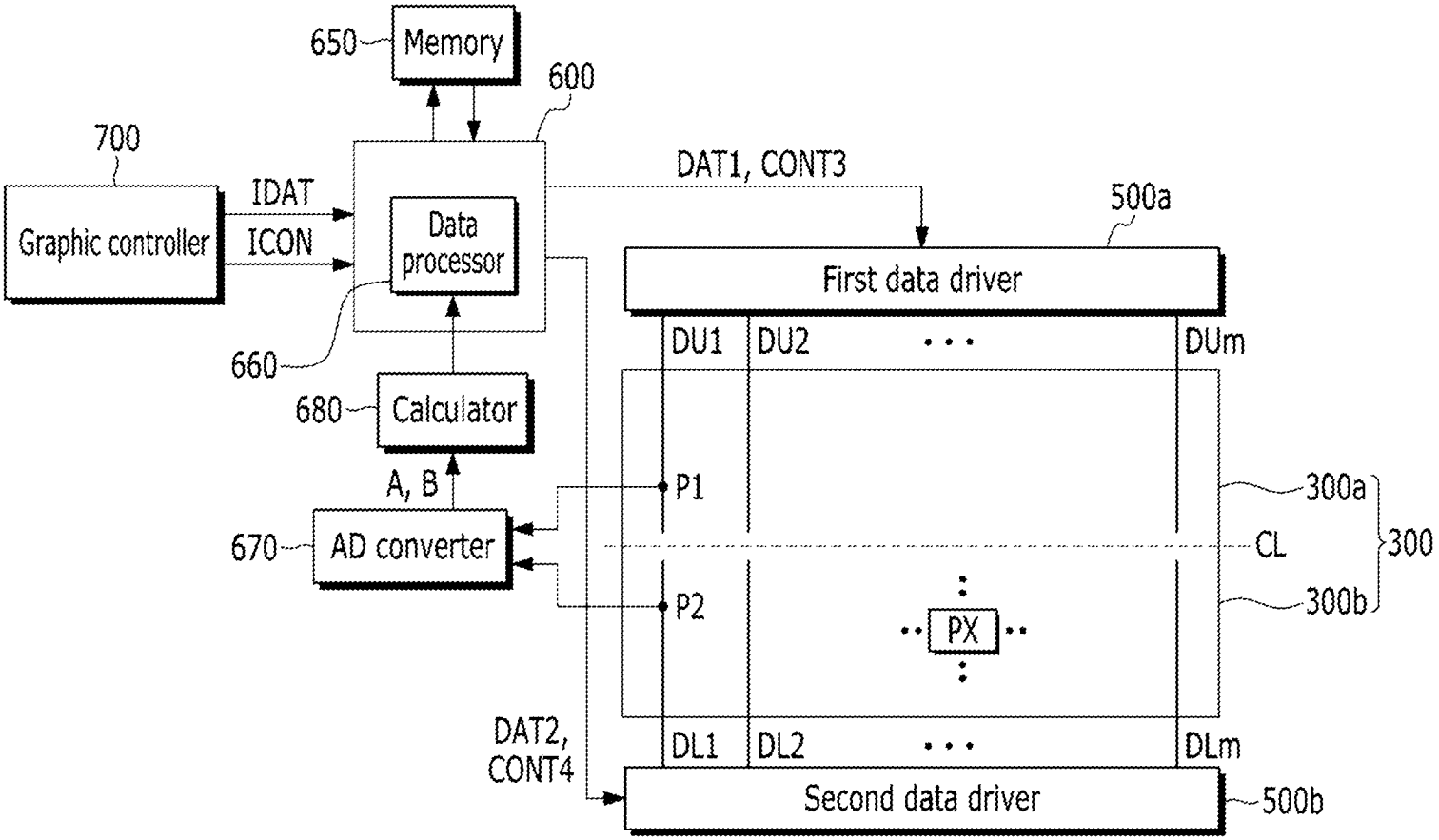
FIG. 9 is a block diagram of the display device according to an exemplary embodiment of the present invention.

FIG. 9 is a block diagram of the display device according to an exemplary embodiment of the present invention.

Referring to FIG. 9, the display device is similar to the aforementioned display device illustrated in FIG. 1, but may further include an analog-digital converter (referring to as an AD converter) 670 and a calculator 680. The illustration of the gate driver is omitted in FIG. 9 for convenience's sake.

The AD converter 670 is connected to a first feedback point P1 that is one node on one upper data line among the upper data lines DU1 to DUm of the upper display panel region 300*a* and a second feedback point P1 that is one node on one lower data line among the upper data lines DL1 to DLm of the lower display panel region 300*b*. The AD converter 670 receives feedback of voltages of the first feedback point P1 and the second feedback point P2 and AD-converts each of the received voltages to generate first and second digital data A and B. The voltages of the first feedback point P1 and the second feedback point P2 may be considered as data voltages applied to the pixels PX adjacent to the first feedback point P1 and the second feedback point P2, respectively. Accordingly, through a comparison between the voltages of the first feedback point P1 and the second feedback point P2 when the data voltage corresponding to the input image signal IDAT of the same gray level is input in the entire display panel 300, it is possible to recognize a luminance difference between the upper display panel region 300*a* and the lower display panel region 300*b* for the input image signal IDAT for the same gray level. The luminance difference may be caused by several factors, such as a deviation of the driving voltages of the first and second data drivers 500*a* and 500*b* or a difference of the signal delays of the upper and lower display panel regions 300*a* and 300*b* as described above.

The calculator 680 receives the first and second digital data A and B from the AD converter 670 to calculate a difference between the first and second digital data A and B. For example, the calculator 680 may obtain a gray difference C by subtracting the second digital data B from the first digital data A and calculating an absolute value of the difference. The gray level difference C may be transmitted to the data processor 660 of the signal controller 600 to be used for the aforementioned data processing.

The AD converter 670 and the calculator 680 may be included in the signal controller 600 or the graphic controller 700, or may be separately provided on the printed circuit board.

A method of processing data by using the gray difference C will now be described with reference to FIGS. 10 and 11 together with the aforementioned drawings.

Figure 10:
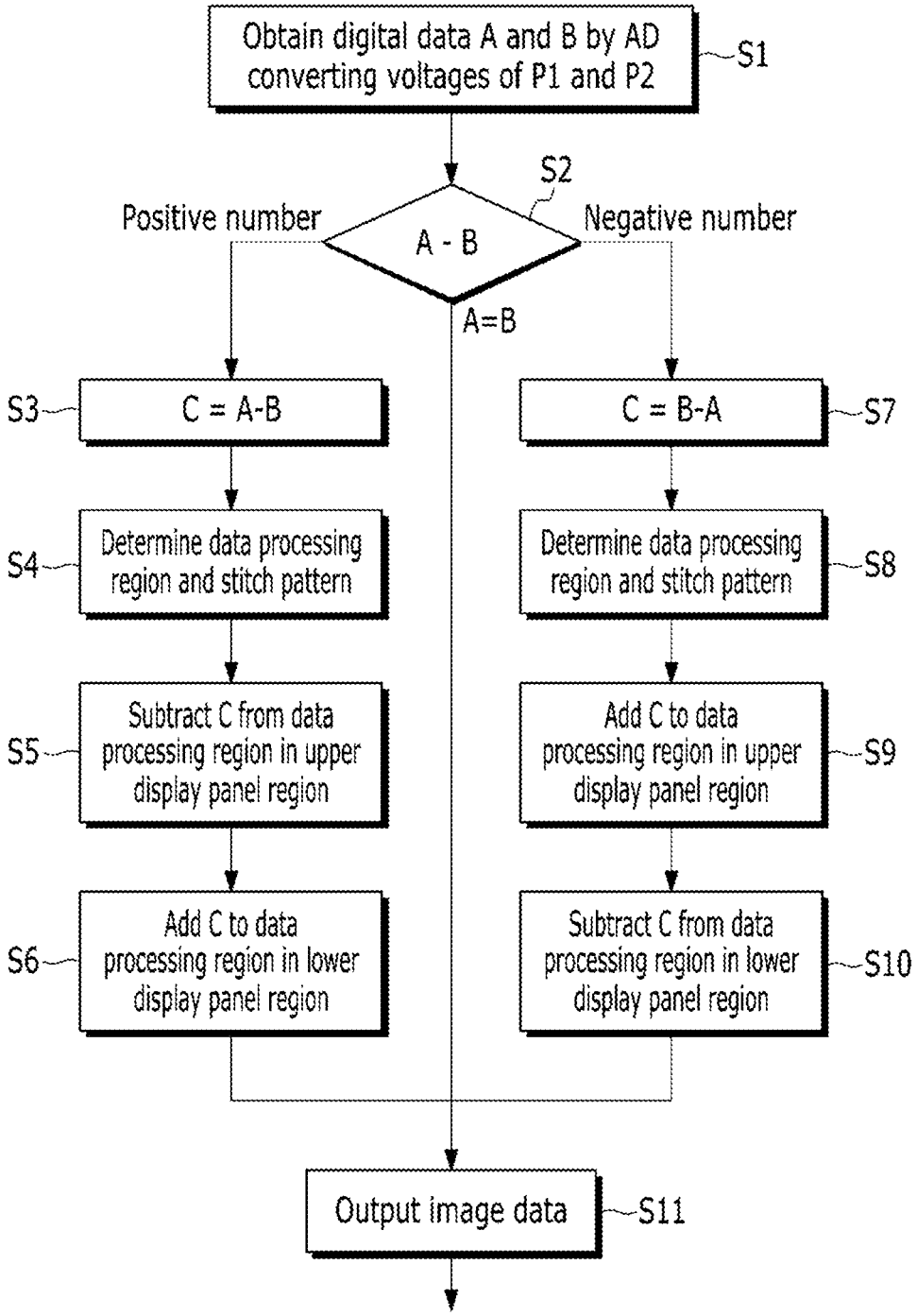
FIG. 10 is a flowchart illustrating a method of processing data in the display device according to an exemplary embodiment of the present invention.
Figure 11:
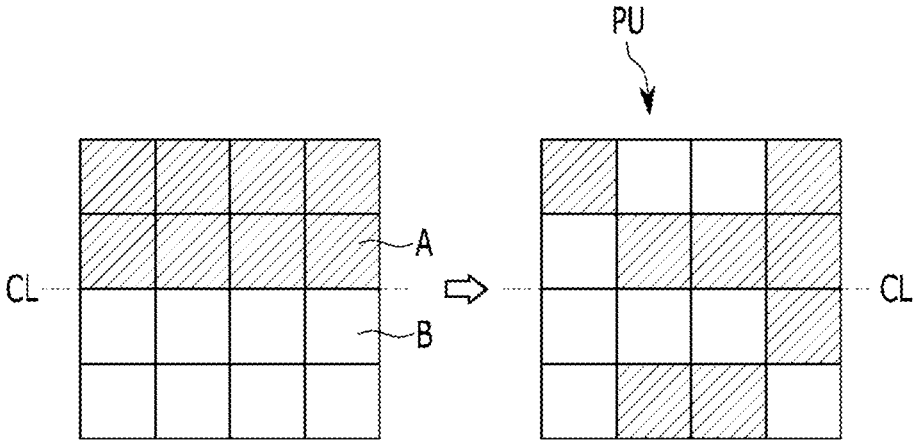
FIG. 11 is a view illustrating a method of processing data for one unit pattern of the stitch pattern in the display device according to an exemplary embodiment of the present invention.

FIG. 10 is a flowchart illustrating a method of processing data in the display device according to an exemplary embodiment of the present invention, and FIG. 11 is a view illustrating a method of processing data for one unit pattern of the stitch pattern in the display device according to an exemplary embodiment of the present invention.

Referring to FIGS. 9 and 10, a data voltage for the input image signal IDAT of the same gray is applied to the display panel 300 as described above. The input image signal IDAT may be white, which is the highest gray level. The AD converter 670 receives feedback of the voltages of the first feedback point P1 and the second feedback point P2, performs an analog-to-digital conversion of the fed back voltages, generates the first and second digital data A and B, and transmits the generated first and second digital data A and B to the calculator 680 (S1). Referring to FIG. 11, the first digital data A of the upper display panel region 300*a* based on the horizontal center line CL of the display panel 300 is displayed with a gray color, and the second digital data B of the lower display panel 300*b* is displayed with a white color.

Next, the calculator 680 calculates a difference between the first and second digital data A and B. FIG. 10 illustrates a case in which the second digital data B is subtracted from the first digital data A as an example.

When the first digital data A of the upper display panel region 300*a* is greater than the second digital data B of the lower display panel region 300*b*, a value obtained by subtracting the second digital data B from the first digital data A is input as a gray difference C (S3). Contrary to this, when the first digital data A of the upper display panel region 300*a* is less than the second digital data B of the lower display panel region 300*b*, a value obtained by subtracting the first digital data A from the second digital data B is input as a gray level difference value C (S7).

Next, the data processing region TA and the stitch pattern are determined by fetching the pre-stored data processing region TA and the stitch pattern (S4 and S8).

Next, when the first digital data A is greater than the second digital data B, the gray level difference value C is subtracted from the original data of a portion of the unit blocks in the data processing region TA of the upper display panel region 300*a* according to the stitch pattern (S5). Here, the original data means data input in the data processor 660. Along with this, the gray level difference value C is added to the original data of a portion of the unit blocks in the data processing region TA of the lower display panel region 300*b* according to the stitch pattern (S6). A sequence of steps S5 and S6 may be changed.

When the first digital data A is less than the second digital data B, the gray level difference value C is added to the original data of a portion of the unit blocks in the data processing region TA of the upper display panel region 300*a* according to the stitch pattern (S9). Along with this, the gray level difference value C is subtracted from the original data of a portion of the unit blocks in the data processing region TA of the lower display panel region 300*b* according to the stitch pattern (S 10). A sequence of steps S9 and S10 may be changed.

The unit pattern PU of the stitch pattern illustrated at a right side of FIG. 11 is the same as the aforementioned unit pattern PU illustrated in FIG. 6. The gray level difference value C may be subtracted from or added to the original data for the three unit blocks BU positioned at an upper side based on the horizontal center line CL and displayed with a white color, or the gray level difference value C may be subtracted from or added to the original data for the three unit blocks BU positioned at a lower side based on the horizontal center line CL and displayed with a gray color, in contrast to the unit blocks BU positioned at the upper side based on the horizontal center line CL.

The data processed as described above is the image data DAT1 and DAT2, and output to the first and second data drivers 500*a* and 500*b* (S 11).

When the first digital data A is the same as the second digital data B, the first digital data A and the second digital data B may follow any one route between the aforementioned two routes, and may be output as the image data DAT1 and DAT2 without the data processing.

As described above, according to an exemplary embodiment of the present invention, in the dual bank method, a luminance difference between the upper display panel region 300*a* and the lower display panel region 300*b* is fed back and a gray level difference value is calculated based on the fed back luminance difference. The data of the data processing region TA is processed according to the stitch pattern by using the gray level difference value. Accordingly, the luminance difference between the upper display panel region 300*a* and the lower display panel region 300*b* is mixed in the vicinity of the horizontal center line CL, so that it is possible to prevent a horizontal line from being viewed.

A detailed method of feeding back the voltages of the first and second feedback points P1 and P2 in the display device according to an exemplary embodiment of the present invention will be described with reference to FIGS. 12 to 14. The same elements as that of the aforementioned exemplary embodiment are denoted with the same reference numerals, and the same descriptions will be omitted.

Figure 12:
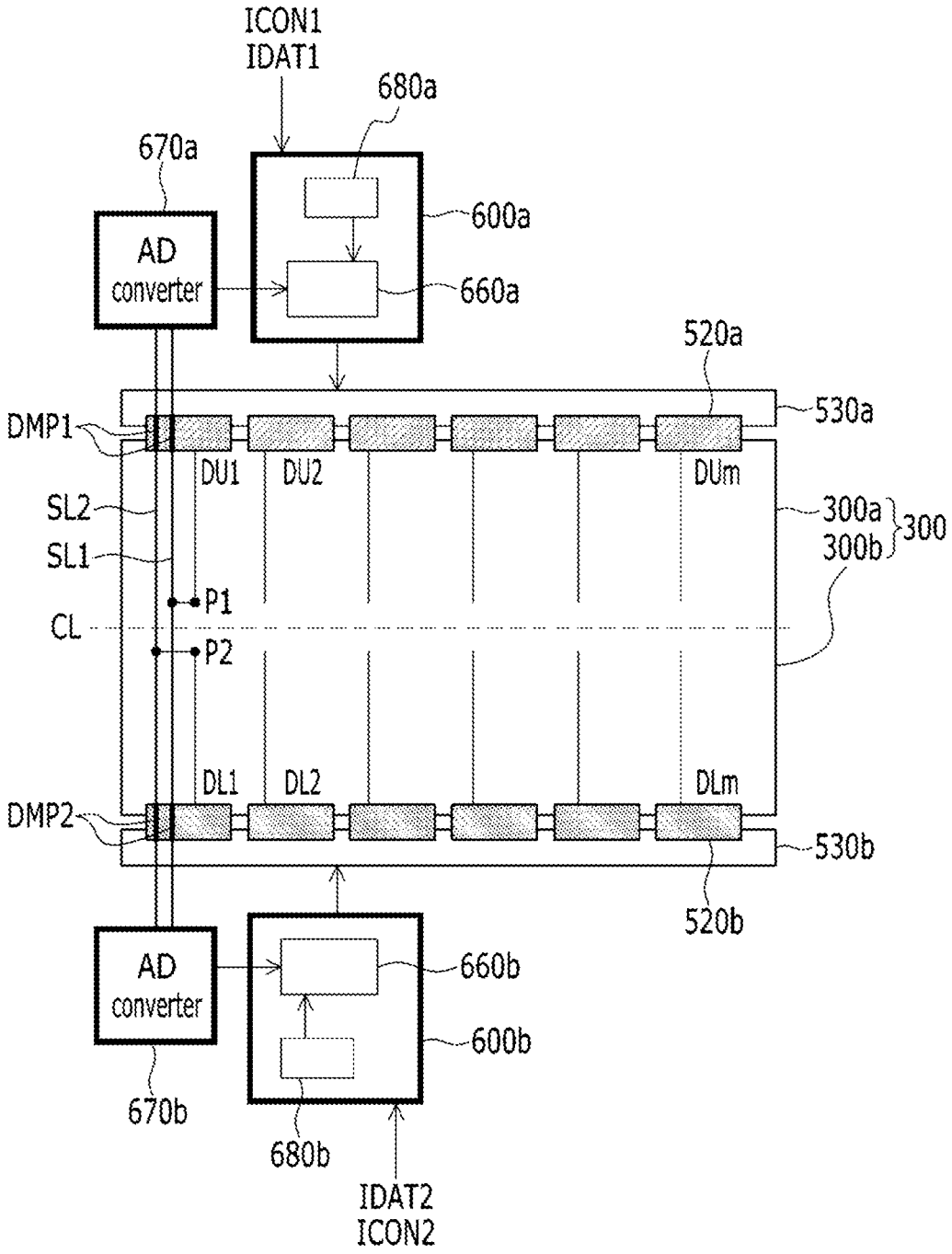
FIG. 12, FIG. 13, and FIG. 14 are block diagrams of display devices according to other exemplary embodiments of the present invention, respectively.
Figure 13:
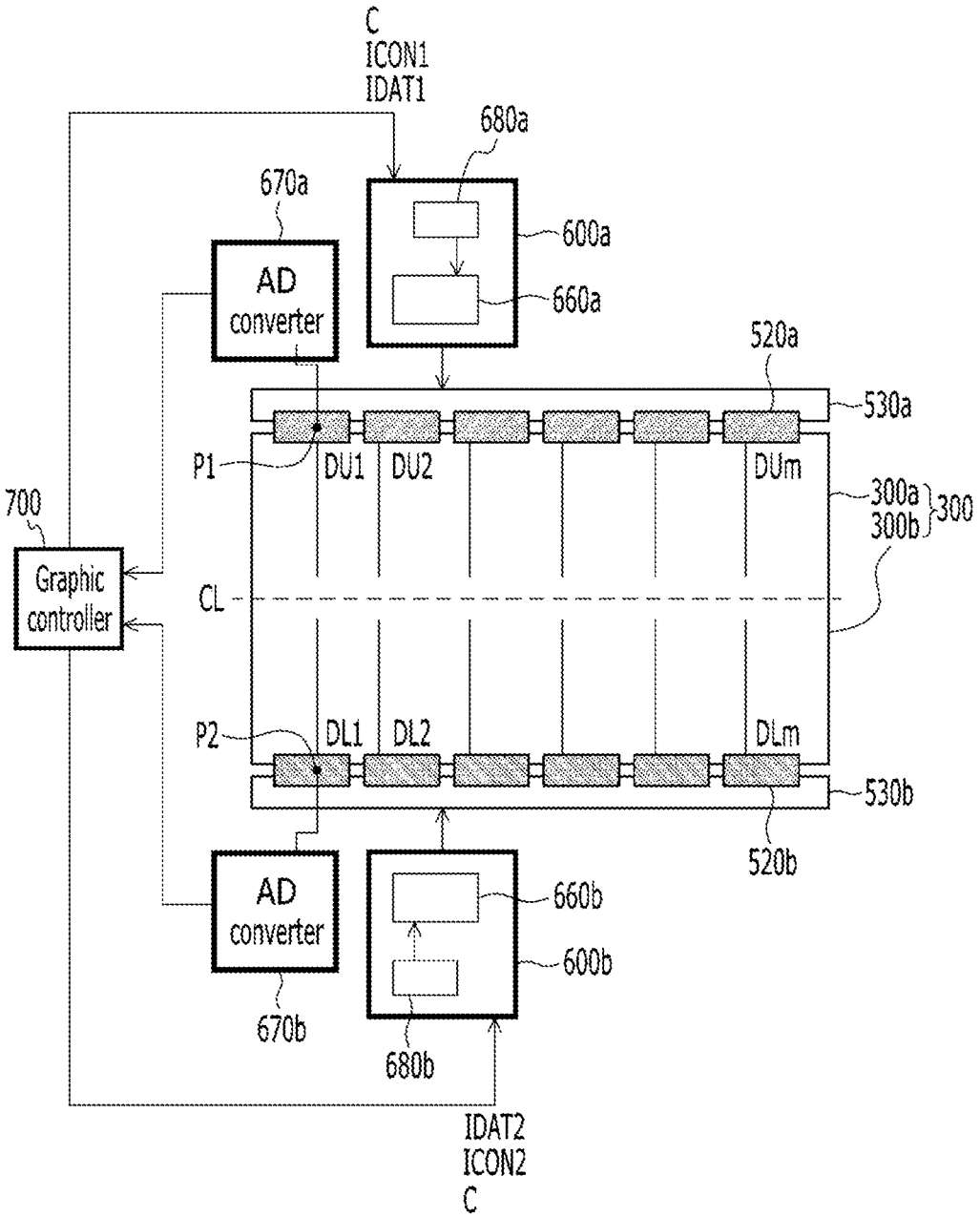
Figure 14:
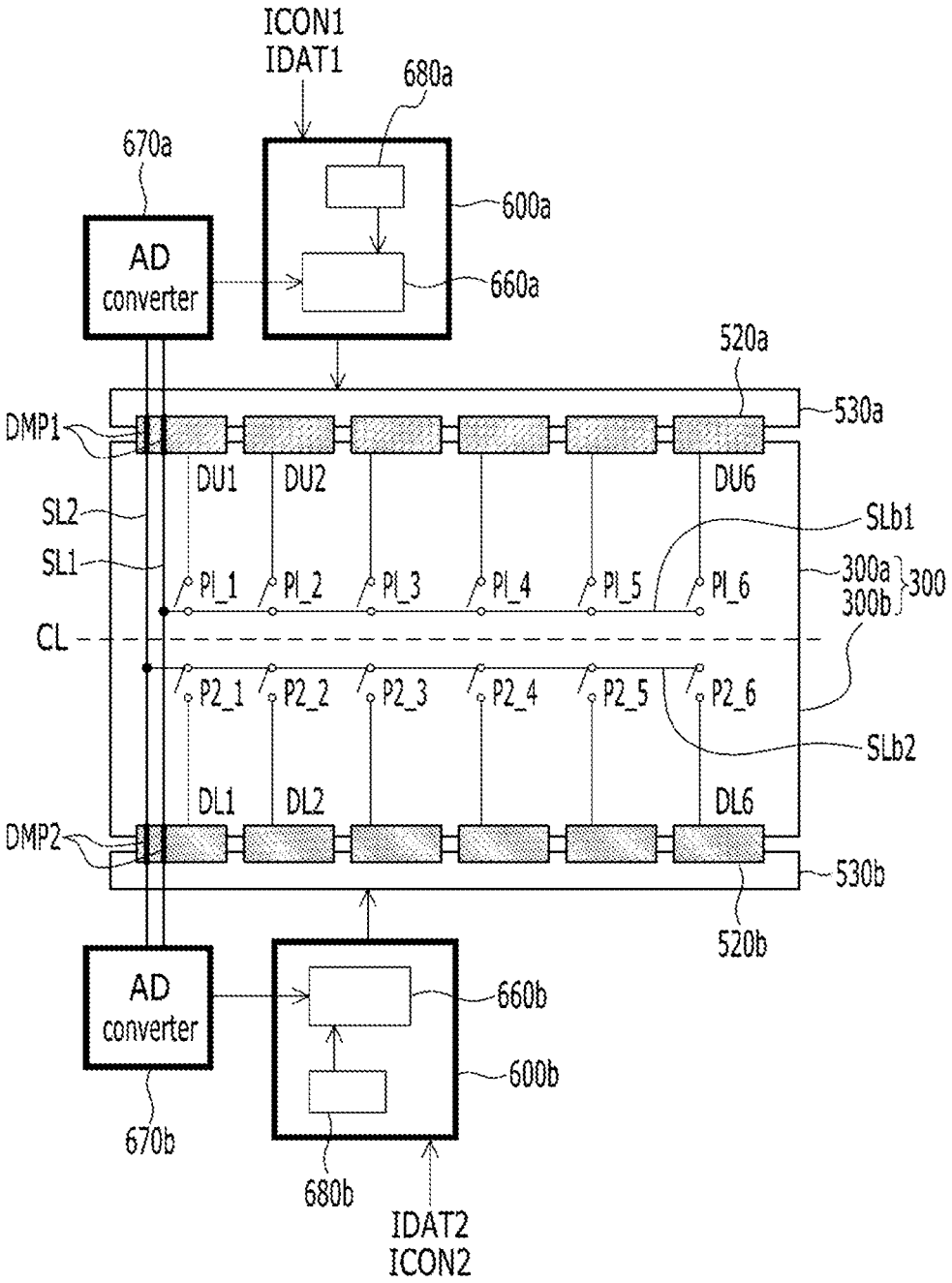

FIGS. 12, 13, and 14 are block diagrams illustrating display devices according to exemplary embodiments of the present invention, respectively. FIGS. 12 to 14 illustrate that one data line is connected to each of the first and second flexible printed circuit films 520*a* and 520*b* for convenience's sake, but the plurality of data lines is connected to the data driving chip positioned on each of the first and second flexible printed circuit films 520*a* and 520*b*.

First, referring to FIG. 12, a display device according to the present exemplary embodiment is mostly the same as the display device according to the aforementioned several exemplary embodiments, but first and second feedback lines SL1 and SL2 are further formed on the display panel 300. The first and the second feedback lines SL1 and SL2 may generally extend in parallel to the upper data line DU1 to DUm and the lower data line DL1 to DLm, and may be connected with the AD converter positioned outside the display panel 300 through dummy pins DMP1 and DMP2 of the data driving chips of the first and second data drivers 500*a* and 500*b*. The first and the second feedback lines SL1 and SL2 may be positioned inside the display region of the display panel 300, and may be positioned in a peripheral region around the display region.

One AD converter according to the present exemplary embodiment may be provided, but first and second AD converters 670*a* and 670*b* separated from each other may be included, as illustrated in FIG. 12. The first and the second AD converters 670*a* and 670*b* are connected to the first and second feedback lines SL1 and SL2, receive the voltages of the first feedback point P1 and the second feedback point P2, perform an analog-to-digital conversion on the received voltages, and generate the first and second digital data A and B, respectively.

The first and the second data drivers 500*a* and 500*b* according to the present exemplary embodiment are connected with the first and second signal controllers 600*a* and 600*b*, respectively, to receive the data control signals CONT3 and CONT4 and the image data DAT1 and DAT2. The first and the second signal controllers 600*a* and 600*b* may receive the input control signals ICON1 and ICON2 and the input image signals IDAT1 and IDAT2 from the graphic controller (not illustrated), and process the received input control signals ICON1 and ICON2 and input image signals IDAT1 and IDAT2, respectively. The first signal controller 600*a* may include the first data processor 660*a*, and the second signal controller 600*b* may include the second data processor 660*b*. Further, the first and the second signal controllers 600*a* and 600*b* may include the memories (not illustrated) operated in the burst mode, or be connected with the memories, respectively.

Further, the first signal controller 600*a* may include a first calculator 680*a*, and the second signal controller 600*b* may include a second calculator 680*b*. The first calculator 680*a* and the second calculator 680*b* receive the first and second digital data A and B from the first and second AD converters 670*a* and 670*b*, respectively, to generate the gray level difference value.

According to another exemplary embodiment of the present invention, the first calculator 680*a* and the second calculator 680*b* may be provided as one calculator 680, as illustrated in FIG. 9; may be separately provided from the first and second signal controllers 600*a* and 600*b*; or may be included in the graphic controller 700.

The first and the second AD converters 670*a* and 670*b* may be included in the first and second signal controllers 600*a* and 600*b*, respectively, and may be included in the graphic controller 700.

Particularly, in the present exemplary embodiment, the first feedback point P1 may be an end portion in the vicinity of the horizontal center line CL in an end portion of one upper data line among the upper data lines DU1 to DUm, and the second feedback point P2 may be an end portion in the vicinity of the horizontal center line CL in an end portion of one lower data line among the lower data lines DL1 to DLm. Accordingly, it is possible to more accurately obtain information on the gray level difference in the vicinity of the horizontal center line CL in which the luminance difference between the upper display panel region 300*a* and the lower display panel region 300*b* is the greatest and the luminance difference may be easily viewed, thereby more effectively preventing the horizontal line from being viewed.

Next, referring to FIG. 13, a display device according to the present exemplary embodiment is the same as the display device according to the exemplary embodiment illustrated in FIG. 12, but the first and second feedback lines SL1 and SL2 may not be present on the display panel 300. In this case, the first AD converter 670*a* may be connected to an output pin of any one data driving chip of the first data driver 500*a*, so that the output pin may serve as the first feedback point P1. The second AD converter 670*b* may be connected to an output pin of any one data driving chip of the second data driver 500*b*, so that the output pin may serve as the second feedback point P2.

The first AD converter 670*a* generates the first digital data A by performing analog-to-digital conversion of the voltage of the first feedback point P1, and the second AD converter 670*b* generates the second digital data B by performing analog-to-digital conversion of the voltage of the second feedback point P2. The first and second digital data A and B are transmitted to the graphic controller 700, and in this case, the gray level difference value C may be calculated. However, according to another exemplary embodiment of the present invention, the first and second digital data A and B are transmitted to one separate calculator (not illustrated), so that the gray level difference value C may be calculated.

The gray level difference value C calculated as described above may be transmitted to the first and second signal controllers 600*a* and 600*b* to be used in the data processing.

According to the present exemplary embodiment, it is difficult to reflect the luminance difference according to the signal delay of the upper display panel region 300*a* and the lower display panel region 300*b*, but in a case where the luminance difference of the same gray level is present by the driving voltage difference between the first and second data drivers 500*a* and 500*b*, and the like, the luminance difference is fed back and is used in the data processing, so that it is possible to prevent the horizontal line from being viewed.

Next, referring to FIG. 14, a display device according to the present exemplary embodiment is similar to the display device according to the exemplary embodiment illustrated in FIG. 12, but a plurality of first feedback points P1_1 to P1_6 and a plurality of feedback points P2_1 to P2_6 may be present. Particularly, when the first data driver 500*a* and the second data driver 500*b* include a plurality of data driving chips, respectively, any one data line among the upper data lines DU1 to DUm or the lower data lines DL1 to DLm connected to the data driving chips, respectively, may include the first feedback points P1_1 to P1_6 or the second feedback points P2_1 to P2_6, respectively. However, as illustrated in FIG. 14, only a portion of the data driving chips of the first data driver 500*a* is connected to the upper data lines DU1 to DUm including the first feedback points P1_1 to P1_6, and only a portion of the data driving chips of the second data driver 500*b* may be connected with the lower data lines DL1 to DLm including the second feedback points P2_1 to P2_6.

The display panel 300 may further include a pair of signal transmission lines SLb1 and SLb2 extending in a horizontal direction while being adjacent to the horizontal center line CL and positioned at opposed sides based on the horizontal center line CL. The first feedback line SL1 may be connected with the upper signal transmission line SLb1 and the second feedback line SL2 may be connected to the lower signal transmission line SLb2.

Each of the plurality of first feedback points P1_1 to P1_6 may be connected to the upper signal transmission line SLb1 through respective switches, and each of the plurality of second feedback points P2_1 to P2_6 may be connected to the lower signal transmission line SLb2 through respective switches. The plurality of switches connected between the upper signal transmission line SLb1 and the plurality of first feedback points P1_1 to P1_6 may be sequentially turned on at a time interval, to transmit the voltages of the first feedback point P1_1 to P1_6 to the first and second AD converters 670*a* and 670*b*. Similarly, the plurality of switches connected between the lower signal transmission line SLb2 and the plurality of second feedback points P2_1 to P2_6 may be sequentially turned on at a time interval, to transmit the voltages of the second feedback point P2_1 to P2_6 to the first and second AD converters 670*a* and 670*b*.

The first and second AD converters 670*a* and 670*b* may generate a plurality of first digital data A for the plurality of first feedback points P1_1 to P1_6 of the upper display panel region 300*a* and a plurality of second digital data B for the plurality of second feedback points P2_1 to P2_6 of the lower display panel region 300*b* by performing analog-to-digital conversion of the sequentially input feedback voltages, respectively.

When the data driving chips corresponding to the first and second data drivers 500*a* and 500*b* make a pair, each independent gray level difference value C for each of the pair of different data driving chips may be generated, and the luminance difference according to the region of the display panel 300 may be accurately recognized. When the data of the data processing region TA is processed by using the generated gray level difference value C, it is possible to more surely prevent the horizontal line from being viewed.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a display device comprising pixels arranged in a matrix, first data lines positioned in a first display panel region, second data lines positioned in a second display panel region, and a horizontal center line dividing the first and second display panel regions, the method comprising:

storing a stitch pattern;

setting a data processing region comprising pixels in the vicinity of the horizontal center line; and performing data processing comprising changing a gray level of data for a portion of the plurality of pixels of the data processing region according to the stitch pattern.

2. The method of claim 1, wherein:

the stitch pattern comprises one or more unit patterns, each of the one or more unit patterns comprises a plurality of unit blocks, each of the plurality of unit blocks comprises N pixels in one pixel row, wherein N is equal to or greater than 2, and N is less than the number of pixels of the one pixel row.

3. The method of claim 2, further comprising:

storing an input image signal from an external source; and outputting the input image signal with a burst length of at least 2, wherein N corresponds to an integer multiple of the burst length.

4. The method of claim 3, wherein:

the unit pattern comprises one or more first unit blocks positioned on the first side of the horizontal center line, and one or more second unit blocks positioned on the second side of the horizontal center line, and the data processing is performed on at least one of the one or more first unit blocks and the one or more second unit blocks.

5. The method of claim 4, wherein, in the performing of data processing, a gray level difference value is added to or subtracted from the data for a portion of the one or more first unit blocks.

6. The method of claim 5, wherein, in the performing of data processing, the gray level difference value is subtracted from or added to the data for a portion of the one or more second blocks.

7. The method of claim 6, further comprising:

feeding back a voltage of one or more first feedback points disposed in the plurality of first data lines;

feeding back a voltage of one or more second feedback points disposed in the plurality of second data lines; and generating first digital data and second digital data by performing an analog-to-digital conversion of the fed back voltages.

8. The method of claim 7, further comprising:

generating the gray level difference value by calculating a difference between the first and second digital data.

9. The method of claim 8, wherein, when the first digital data is larger than the second digital data, the method further comprises:

subtracting the gray level difference value from the data for a portion among the one or more first unit blocks of the unit pattern; and adding the gray level difference value to the data for a portion among the one or more second unit blocks of the unit pattern.

10. The method of claim 9, wherein:

when the plurality of first data lines comprises a plurality of first feedback points, and the plurality of second data lines comprises a plurality of second feedback points, the voltages of the plurality of first feedback points are sequentially fed back, and the voltages of the plurality of second feedback points are sequentially fed back.

11. The method of claim 10, wherein:

the first feedback point is disposed at an output pin of the first data driver, and the second feedback point is disposed at an output pin of the second data driver.

12. The method of claim 2, wherein:

the unit pattern comprises one or more first unit blocks disposed at the first side of the horizontal center line and one or more second unit blocks disposed at the second side, and the data processing is performed on at least one of the one or more first unit blocks and the one or more second unit blocks.

13. The method of claim 12, wherein, in the performing of data processing, a gray level difference value is added to or subtracted from the data for a portion among the one or more first unit blocks.

14. The method of claim 12, wherein, in the performing of data processing, the gray level difference value is subtracted from or added to the data for a portion among the one or more second blocks.

15. The method of claim 1, further comprising:

feeding back a voltage of one or more first feedback points disposed in the plurality of first data lines;

feeding back a voltage of one or more second feedback points disposed in the plurality of second data lines; and generating first digital data and second digital data by performing an analog-to-digital conversion of the fed back voltages.

16. The method of claim 15, further comprising:

generating the gray level difference value by calculating a difference between the first and second digital data.

17. The method of claim 16, wherein, when the first digital data is greater than the second digital data, the method further comprises:

subtracting the gray level difference value from the data for a portion of the one or more first unit blocks of the unit pattern; and adding the gray level difference value to the data for a portion of the one or more second unit blocks of the unit pattern.

18. The method of claim 15, wherein, when the plurality of first data lines comprises a plurality of the first feedback points, and the plurality of second data lines comprises a plurality of the second feedback points:

the voltages of the plurality of first feedback points are sequentially fed back, and the voltages of the plurality of second feedback points are sequentially fed back.

19. The method of claim 15, wherein:

the first feedback point is disposed at an output pin of the first data driver, and the second feedback point is disposed at an output pin of the second data driver.

20. A display device, comprising:

a display panel comprising a plurality of pixels arranged in a matrix, a plurality of first data lines disposed in a first display panel region on a first side of a horizontal center line, and a plurality of second data lines disposed in a second display panel region on a second side of the horizontal center line opposite the first side;

a first data driver configured to apply data voltages to the plurality of first data lines;

a second data driver configured to apply data voltages to the plurality of second data lines; and a signal controller configured to control the first and second data drivers and comprising a data processor, wherein the data processor is configured to generate image data by performing data processing of changing gray levels of data for a portion of the plurality of pixels in a data processing region disposed in a vicinity of the horizontal center line of the display panel according to a stitch pattern.

21. The display device of claim 20, wherein:

the stitch pattern comprises at least one unit pattern, each of the one or more unit patterns comprises a plurality of unit blocks, each of the plurality of unit blocks comprises N pixels of one pixel row, and N is equal to or greater than 2, and N is less than a number of pixels of the one pixel row.

22. The display device of claim 21, further comprising:

a memory configured to store an input image signal input by the signal controller, and to output the input image signal with a burst length of at least 2, wherein N corresponds to an integer multiple of the burst length.

23. The display device of claim 22, wherein:

the unit pattern comprises at least one first unit block disposed on the first side of the horizontal center line, and at least one second unit block disposed on the second side of the horizontal center line, and the data processing is performed on at least one of the at least one first unit block and the at least one second unit block.

24. The display device of claim 23, wherein a gray level difference value is added to or subtracted from the data for a portion of the one or more first unit blocks.

25. The display device of claim 24, wherein the gray level difference value is subtracted from or added to the data for a portion of the at least one second block.

26. The display device of claim 25, wherein:

the plurality of first data lines comprises one or more first feedback points, the plurality of second data lines comprises one or more second feedback points, and the display device further comprises an AD converter configured to receive a voltage of the first feedback point and a voltage of the second feedback point, perform an analog-to-digital conversion of the received voltages, and generate first digital data and second digital data.

27. The display device of claim 26, further comprising:

a calculator configured to generate the gray level difference value by calculating a difference between the first and second digital data.

28. The display device of claim 27, wherein, when the first digital data is greater than the second digital data:

the gray level difference value is subtracted from the data for a portion of the one or more first unit blocks of the unit pattern, and the gray level difference value is added to the data for a portion of the one or more second unit blocks of the unit pattern.

29. The display device of claim 28, wherein:

the first feedback point is disposed at an end portion of at least one of the plurality of first data lines, and the second feedback point is disposed at an end portion of at least one of the plurality of second data lines.

30. The display device of claim 29, further comprising:

a first feedback line configured to connect the first feedback point and the AD converter; and a second feedback line configured to connect the second feedback point and the AD converter.

31. The display device of claim 30, wherein the first feedback line and the second feedback line are connected to the AD converter through a dummy pin of at least one data driving chip of the first and second data drivers.

32. The display device of claim 31, wherein:

when the plurality of first data lines comprises a plurality of first feedback points, and the plurality of second data lines comprises a plurality of second feedback points, the plurality of first feedback points are connected to the first feedback line through a plurality of first switches, and the plurality of second feedback points are connected to the second feedback line through a plurality of second switches.

33. The display device of claim 32, wherein the plurality of first switches and the plurality of second switches are sequentially turned on at a time interval.

34. The display device of claim 28, wherein:

the first feedback point is disposed at an output pin of the first data driver, and the second feedback point is disposed at an output pin of the second data driver.

35. The display device of claim 21, wherein:

the unit pattern comprises at least one first unit block disposed on the first side of the horizontal center line and at least one second unit block disposed on the second side of the horizontal center line, and the data processing is performed on at least one of the first unit blocks and the second unit blocks.

36. The display device of claim 35, wherein a gray level difference value is added to or subtracted from the data for a portion of the one or more first unit blocks.

37. The display device of claim 35, wherein the gray level difference value is subtracted from or added to the data for a portion of the one or more second blocks.

38. The display device of claim 20, wherein:

the plurality of first data lines comprises one or more first feedback points, the plurality of second data lines comprises one or more second feedback points, and the display device further comprises an AD converter configured to receive a voltage of the first feedback point and a voltage of the second feedback point, perform an analog-to-digital conversion of the received voltages, and generate first digital data and second digital data.

39. The display device of claim 38, further comprising a calculator configured to generate the gray level difference value by calculating a difference between the first and second digital data.

40. The display device of claim 39, wherein:

when the first digital data is greater than the second digital data, the gray level difference value is subtracted from the data for a portion of the at least one first unit block of the unit pattern, and the gray level difference value is added to the data for a portion of the at least one second unit block of the unit pattern.

41. The display device of claim 38, wherein:

the first feedback point is disposed at an end portion of at least one of the plurality of first data lines, and the second feedback point is disposed at an end portion of at least one of the plurality of second data lines.

42. The display device of claim 41, further comprising:

a first feedback line configured to connect the first feedback point and the AD converter; and a second feedback line configured to connect the second feedback point and the AD converter.

43. The display device of claim 42, wherein the first feedback line and the second feedback line are connected to the AD converter through a dummy pin of at least one data driving chip of the first and second data drivers.

44. The display device of claim 38, wherein, when the plurality of first data lines comprises a plurality of first feedback points, and the plurality of second data lines comprises a plurality of second feedback points, the plurality of first feedback points are connected to the first feedback line through a plurality of first switches, and the plurality of second feedback points are connected to the second feedback line through a plurality of second switches.

45. The display device of claim 44, wherein the plurality of first switches and the plurality of second switches are sequentially turned on at a time interval.

46. The display device of claim 38, wherein:

the first feedback point is disposed at an output pin of the first data driver, and the second feedback point is disposed at an output pin of the second data driver.

* * * * *